US006541716B2

(12) United States Patent
Gotoh

(10) Patent No.: US 6,541,716 B2
(45) Date of Patent: Apr. 1, 2003

(54) MULTIDIRECTIONAL SWITCH DEVICE IN WHICH DIFFERENCES IN TACTILE FEEL ARE REDUCED

(75) Inventor: Kazunori Gotoh, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/784,545

(22) Filed: Feb. 15, 2001

(65) Prior Publication Data

US 2001/0032776 A1 Oct. 25, 2001

(30) Foreign Application Priority Data

Feb. 16, 2000 (JP) ..... 2000-043610

(51) Int. Cl.[7] ..... H01H 19/60
(52) U.S. Cl. ..... 200/6 A; 200/521
(58) Field of Search ..... 200/6 A, 18, 341, 200/513, 521; 400/491.3

(56) References Cited

U.S. PATENT DOCUMENTS 5,744,765 A * 4/1998 Yamamoto ..... 200/6 A
2001/0013464 A1 * 8/2001 Takasuki ..... 200/6 A

FOREIGN PATENT DOCUMENTS

DE 4326226 * 2/1994

* cited by examiner

*Primary Examiner*—Renee Luebke
(74) *Attorney, Agent, or Firm*—Brinks Hofer Gilson & Lione

(57) ABSTRACT

A switch device including an operating member which includes a plurality of actuating sections, opposing corresponding spring sections, for operating their corresponding spring sections. By actuating the actuating sections, corresponding switches are switched. Ends of the actuating sections which oppose their corresponding spring sections are inclined in the outward direction of the operating member. The tilt angle of an actuating section which opposes its corresponding spring section which is not provided along with a switch is greater than the tilt angle of an actuating section which opposes its corresponding spring section which is provided along with its corresponding switch. In a conventional switch device, one or two switches are actuated depending on what portion of the operating member is pressed. Therefore, differences in the clicking characteristics are produced. This gives rise to the problem that an operator which operates the operating member experiences a different tactile feel when operating the operating member. The invention provides a switch device which provides uniform operability.

5 Claims, 11 Drawing Sheets

MULTIDIRECTIONAL SWITCH DEVICE IN WHICH DIFFERENCES IN TACTILE FEEL ARE REDUCED

BACKGROUND OF THE INVENTION

1. Field of the Invention

The present invention relates to a switch device, and, more particularly, to a switch device which is suitable for use in driving a mirror of an automobile.

2. Description of the Related Art

The switch device is used for remotely controlling a mirror which is mounted to, for example, the body of an automobile from the driver's seat by the driving power of a motor. In addition, the switch device is used to selectively operate a plurality of switches which are disposed inside a case by pressing an operating section which is rockably stopped at the top portion of the case.

A description of a conventional switch device is given with reference to the relevant drawings.

FIG. 15 is an exploded perspective view of the conventional switch drive. FIG. 16 is a sectional view of the conventional switch device.

As shown in FIG. 15, the conventional switch device comprises a case 21 having an open bottom end and a cover 29 for covering the open end of the case 21. The case 21 and the cover 29 are snappingly coupled together, whereby the external shell of the switch device is formed.

A printed wiring board 28 is placed on the cover 29. The printed wiring board 28 has three stationary contacts 28*a* formed thereon. Three sliding members 25 are placed above the corresponding stationary contacts 28*a* which are formed on the printed wiring board 28. The three sliding members 25 have corresponding movable contacts 27 formed thereon such that they come into contact with and separate from their corresponding stationary contacts 28*a* by sliding.

The three stationary contacts 28*a* which are formed on the printed wiring board 28 and the three sliding members 25 which have the corresponding movable contacts 27 affixed thereto form three switches.

A substantially square recess 21*a* is formed in the top surface of the case 21. Clearance holes 21*b* are formed in three of the four corners of the recess 21*a*.

A protruding wall 21*d* having a through hole 21*c* is formed in the center of the recess 21*a*.

Three actuating members 22 are provided, each of which comprises a circular cylindrical base 22*a* and substantially semicircular ends 22*b* which are provided on both ends of its corresponding base 22*a*.

A rubber spring 23 comprises a flat, substantially rectangular base 23*a*, substantially dome-shaped spring sections 23*b*-1, 23*b*-2, 23*b*-3, and 23*b*-4, and planar presser sections 23*c*-1, 23*c*-2, 23*c*-3, and 23*c*-4. The spring sections 23*b*-1, 23*b*-2, 23*b*-3, and 23*b*-4 are formed on the four corners of the base 23*a*, respectively. The presser sections 23*c*-1, 23*c*-2, 23*c*-3, and 23*c*-4 have circular cylindrical shapes, are formed on ends of the corresponding spring sections 23*b*-1, 23*b*-2, 23*b*-3, and 23*b*-4, and have their ends formed parallel to the base 23*a*, that is, in a horizontal direction.

A rectangular through hole 23*d* is formed in the center of the base 23*a*. An inside wall 23*e* is formed on the base 23*a* in a standing manner so as to surround the peripheral. portion of the through hole 23*d*.

The rubber spring 23 is accommodated inside the recess 21*a* of the case 21. At this time, the actuating members 22 are in contact with the inside walls of the three corresponding presser sections 23*c*1, 23*c*-2, and 23*c*-3, and are disposed so as to be slidable inside their corresponding clearance holes 21*b* in the case 21. The through hole 23*d* in the rubber spring 23 is disposed so as to oppose the through hole 21*c* in the case 21.

As shown in FIG. 16, an operating member 24 is formed of, for example, a synthetic resin material by molding. The operating member 24 comprises a substantially rectangular top wall 24*a*, side walls 24*b* which extend in a substantially vertical direction from the peripheral ends of the top wall 24*a* so as to surround the peripheral end portions of the top wall 24*a*, and four cylindrical actuating sections 24*c* which are cross-shaped in cross section and which protrude inwardly from the vicinity of the four corresponding corners of the top wall 24*a*.

An end surface of each actuating section 24*c* of the operating member 24 is formed with the same predetermined tilt angle $\alpha 1$ (such as, approximately three degrees) with respect to the top wall 24*a* (that is, the horizontal plane). Each end surface extends radially outward from substantially the center of the operating member 24.

A description of the operation of the switch device will now be given.

As shown in FIG. 15, when, for example, the operator presses substantially the center portion of the lower left end side of the operating member 24 shown in FIG. 15 with, for example, his/her finger (not shown), the operating member 24 tilts to the lower left side. When the operating member 24 tilts to the lower left side, the two left actuating sections 24*c* and 24*c* of the operating member 24 are pushed downward. When these two left actuating sections 24*c* and 24*c* are pushed, the corresponding presser sections 23*c*1 and 23*c*2 of the rubber spring 23 which have been brought-into contact with the two left actuating sections 24*c* and 24*c* are pushed downward.

When the presser sections 23*c*-1 and 23*c*-2 of the rubber spring 23 are pushed, each of the spring sections 23*b*-1 and 23*b*-2 buckles as the operator is provided with a tactile feel, so that the operator is provided with a proper tactile feel. At this time, the presser sections 23*c*-1 and 23*c*-2 cause the two actuating members 22 which are in contact with the inside walls of their corresponding presser sections 23*c*-1 and 23*c*-2 to be pushed and to slide downward.

When these two actuating members 22 slide downward, the ends 22*b* of each of these actuating members 22 move downward on inclined portions 25*c* of the two corresponding sliding members 25. Here, these two sliding members 25 slide, along with their corresponding movable contacts 27, above the corresponding stationary contacts 28*a* which are formed on the printed wiring board 28 so as to go against the resilient forces of corresponding coil springs 26.

When these two sliding members 25 slide, each of the corresponding movable contacts 27 comes into contact with its corresponding stationary contact 28*a*, so that two switches are brought into an on state at the same time.

Next, when the operator moves his/her finger off the operating member 24, the resilient forces of the two corresponding coil springs 26 cause the two corresponding sliding members 25 to slide back to their original positions. Here, each of the corresponding movable contacts 27 separates from its corresponding stationary contact 28*a*, so that the two switches are brought-into an off state.

By the sliding of the two sliding members 25, the corresponding actuating members 22 are pushed upward, and the operating member 24 is pushed upward to its original position by the self-restoring force of the rubber spring 23.

As shown in FIG. 15, when the operator presses, for example, substantially the center portion of the upper left end side of the operating member 24 shown in FIG. 15 with, for example, his/her finger (not shown), the operating member 24 tilts to the upper left side. When the operating member 24 tilts to the upper left side, the corresponding actuating sections 24*c* of the operating member 24 are pushed downward. When the actuating sections 24*c* are pushed downward, the presser sections 23*c*-1 and 23*c*-4 of the rubber spring 23 which have come into contact with the actuating sections 24*c* are pushed downward.

The operations which follow the pushing down of the presser sections 23*c*-1 and 23*c*-4 are substantially the same as those when substantially the center portion of the lower left side of the operating member 24 is pressed, so that the details thereof will be omitted. However, since an actuating member 22 and a switch are not provided below the presser section 23*c*-4, the one switch which is disposed below the presser section 23*c*-1 is brought into an on state. Thereafter, the actuating member 22 disposed below the presser section 23*c*-1 returns to its original position by the restoring force of the rubber spring 23, so that the one switch is brought into an off state.

A description of the clicking characteristics which are provided during the operation of the switch device will be given.

FIG. 17 is a graph illustrating the clicking characteristic which is provided when two switches of the conventional switch device are actuated. FIG. 18 is a graph illustrating the clicking characteristic which is provided when one switch of the conventional switch device is actuated.

As shown in FIG. 17, when two switches are actuated by pushing, for example, the spring sections 23*b*-1 and 23*b*-2 at the same time as a result of pushing a predetermined location of the operating member 24 (see FIG. 15) of the conventional switch device, the clicking characteristic represented by graph C is obtained. Graph C represents the clicking characteristic in which the change in load which occurs when the corresponding spring sections buckle becomes small due to the actuating forces required to actuate two switches.

As shown in FIG. 18, when only one switch is actuated by pushing, for example, the spring section 23*b*-1 and the spring section 23*b*-4 at the same time as a result of pushing a predetermined location of the operating member 24 of the conventional switch device, the clicking characteristic represented by graph D is obtained. Graph D represents the clicking characteristic in which the change in load is greater than in Graph C because an actuating force for actuating only one switch is required.

As can be understood from the foregoing description, the conventional switch device exhibits the clicking characteristic shown in either graph C or graph D, so that a difference in the clicking characteristics occurs depending on the pressing location.

In the conventional switch device, either one or two switches are actuated depending on the pressing location (that is, the operating location) of the operating member. Therefore, the clicking characteristic which is provided when one switch is actuated and that which is provided when two switches are actuated are different, giving rise to the problem that the operator experiences a different tactile sense when operating the operating member.

SUMMARY OF THE INVENTION

Accordingly, in order to overcome the above-described problem, it is an object of the present invention to provide a switch device which is uniformly operable as a result of providing a uniform tactile feel regardless of the directions of pressing locations of an operating member which is operated by an operator with, for example, his/her finger.

According to the present invention, there is provided a switch device comprising a case, an operating member which is rockably supported by the case, a plurality of spring sections which are disposed inside the case, and a plurality of switches which are disposed inside the case. The operating member includes a plurality of actuating sections. The plurality of spring sections are actuated by the actuating sections. The plurality of switches are switched by the corresponding actuating sections. In the switch device, when the operating member is not operated, the actuating sections and the spring sections oppose each other with predetermined tilt angles in an outward direction of the operating member. The total number of switches is made less than the total number of spring sections so that one or more of the spring sections are provided along with the corresponding switch or switches and one or more of the spring sections are not provided along with a switch or switches. The tilt angle or the tilt angles which correspond to the spring section or the spring sections which are not provided along with a switch or switches are larger than the tilt angle or tilt angles which correspond to the spring section or the spring sections which are provided along with the corresponding switch or switches.

The tilt angle of an end of the actuating section which opposes the corresponding spring section which is provided along with the corresponding switch or the tilt angles of ends of the actuating sections which oppose the corresponding spring sections which are provided along with the corresponding switches may be set such that, when the operating member rocks, the operating member comes into close contact with an end of the corresponding spring section or ends of the corresponding spring sections at a substantially horizontal location the moment the spring section or spring sections buckle.

When the tilt angle or tilt angles are set as described above, the actuating sections may be resiliently biased by the spring sections, the operating member being stopped by the case by the resilient forces of the spring sections.

When the actuating sections are resiliently biased by the spring sections, and the operating member is stopped by the case by the resilient forces of the spring sections, four of the spring sections and three of the switches may be provided, and two of the four spring sections may be actuated at the same time by rocking the operating member.

When four of the spring sections and three of the switches are provided, and two of the four spring sections are actuated at the same time by rocking the operating member, each switch may comprise a printed wiring board disposed inside the case, a stationary contact which is formed on the printed wiring board corresponding thereto, a slider which slides above the printed wiring board corresponding thereto, and a movable contact which is disposed at its corresponding slider. Each slider may slide by its corresponding spring section in order to switch the corresponding switch.

DESCRIPTION OF THE PREFERRED EMBODIMENT

A description of a switch device of the present invention will be given with reference to the relevant drawings.

Figure 1:
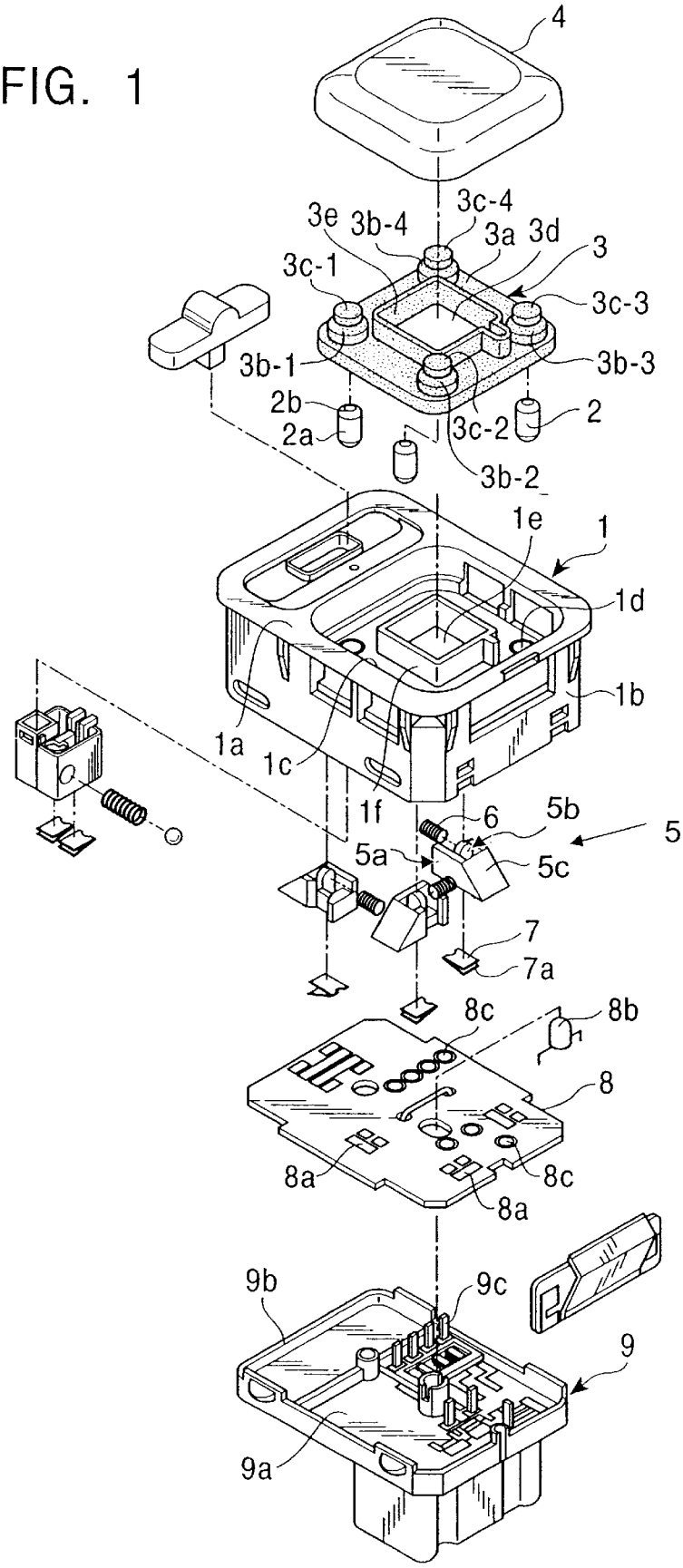
FIG. 1 is an exploded perspective view of an embodiment of a switch device in accordance with the present invention.
Figure 2:
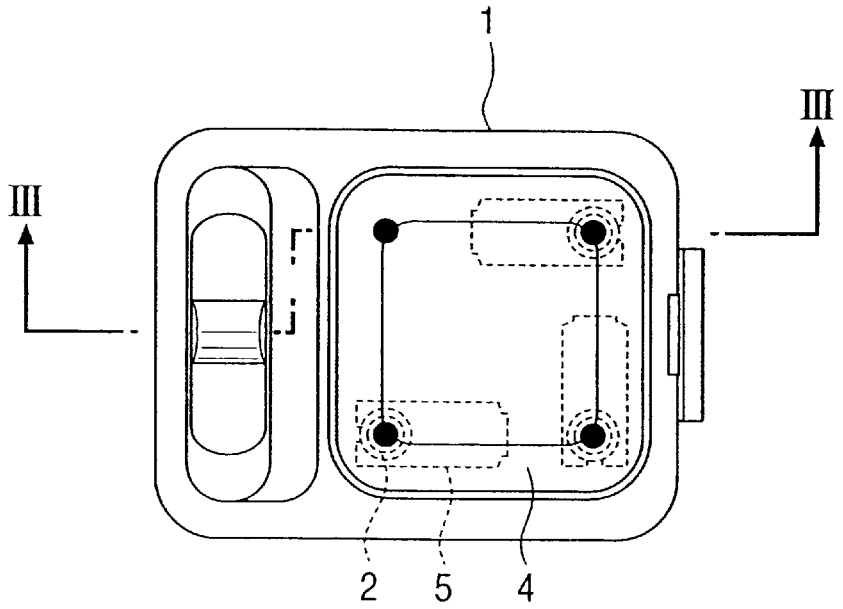
FIG. 2 is a plan view of the embodiment of the switch device in accordance with the present invention.
Figure 3:
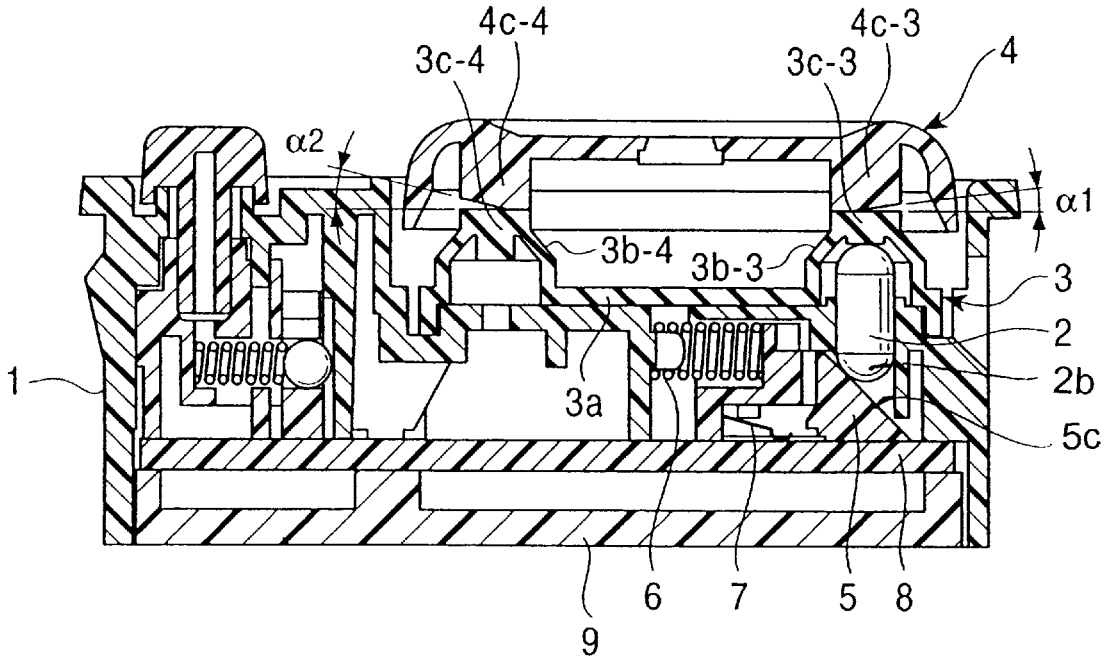
FIG. 3 is an enlarged sectional view taken along line III—III of FIG. 2.

FIG. 1 is an exploded perspective view of an embodiment of a switch device in accordance with the present invention. FIG. 2 is a plan view of the embodiment of the switch device in accordance with the present invention. FIG. 3 is an enlarged sectional view taken along line III—III of FIG. 2.

As shown in FIG. 1, a case 1 is formed of, for example, a synthetic resin material by molding, and is substantially box-shaped. The case 1 comprises a substantially rectangular top wall 1*a*, side walls 1*b* which extend vertically from near the outer peripheral end of the top wall 1*a* so as to surround all sides of the case 1, and a substantially rectangular recess 1*c* which is formed in the top wall 1*a*.

Circular clearance holes 1*d*, a rectangular through hole 1*e*, and a protruding wall If are formed at the recess 1*c*. The clearance holes 1*d* are formed near three of the four corners of the recess 1*c*. The through hole 1*e* is formed in the center of the recess 1*c*. The protruding wall if extends vertically into the recess 1*c* from the periphery of the through hole 1*e*.

Although not shown, the side of the case 1 opposing the top wall 1*a* is open.

Three actuating members 2 are formed of, for example, a synthetic resin material by molding. Each actuating member 2 comprises a circular cylindrical base 2*a* and semicircular ends 2*b* which are provided on both ends of its corresponding base 2*a*.

Each actuating member 2 is slidably disposed in its corresponding clearance hole 1*d* in the case 1. Here, the ends 2*b* of each actuating member 2 are disposed so as to protrude outwardly from their corresponding clearance holes 1*d*.

A rubber spring 3 is formed of, for example, a resilient rubber material by molding. The rubber spring 3 comprises a flat, substantially rectangular base 3*a*, substantially dome-shaped first, second, third, and fourth spring sections 3*b*-1, 3*b*-2, 3*b*-3, and 3*b*-4, and planar first, second, third, and fourth presser sections 3*c*-1, 3*c*-2, 3*c*-3, and 3*c*-4. The first, second, third, and fourth spring sections 3*b*-1, 3*b*-2, 3*b*-3, and 3*b*-4 are provided at the four corners of the base 3*a*, respectively. The first, second, third, and fourth presser sections 3*c*-1, 3*c*-2, 3*c*-3, and 3*c*-4 have circular cylindrical shapes, are formed on ends of the corresponding first, second, third, and fourth spring sections 3*b*-1, 3*b*-2, 3*b*-3, and 3*b*-4, and have their ends formed parallel to the base 3*a*, that is, in a horizontal direction. A rectangular hole 3*d* is formed in the center of the base 3*a*. An inside wall 3*e* is formed on the base 3*a* in a standing manner so as to surround the hole 3*d*.

The rubber spring 3 is accommodated inside the recess 1*c* in the case 1. Here, the actuating members 2 are disposed in contact with the inside surfaces of the corresponding first, second, and third presser sections 3*c*-1, 3*c*-2, and 3*c*-3. The hole 3*d* of the rubber spring 3 is disposed so as to oppose a square hole 1*e* of the case 1.

Figure 4:
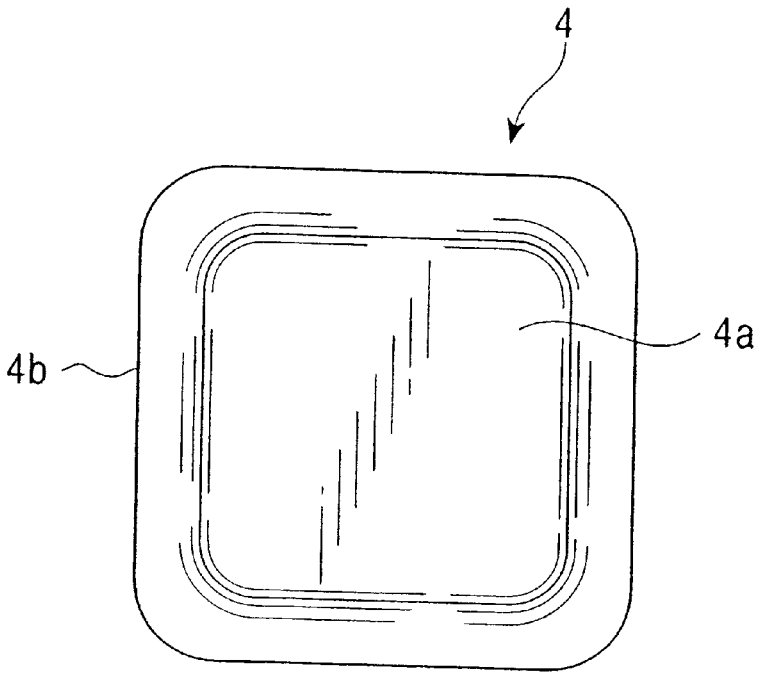
FIG. 4 is a plan view of an operating member of the embodiment of the switch device in accordance with the present invention.
Figure 5:
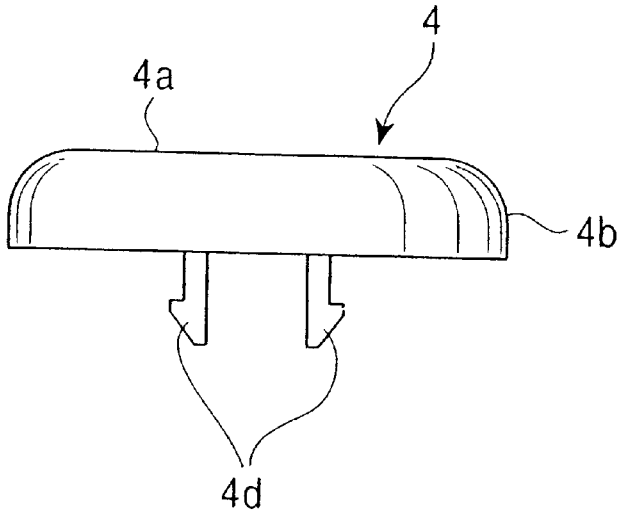
FIG. 5 is a side view of the operating member of the embodiment of the switch device in accordance with the present invention.
Figure 6:
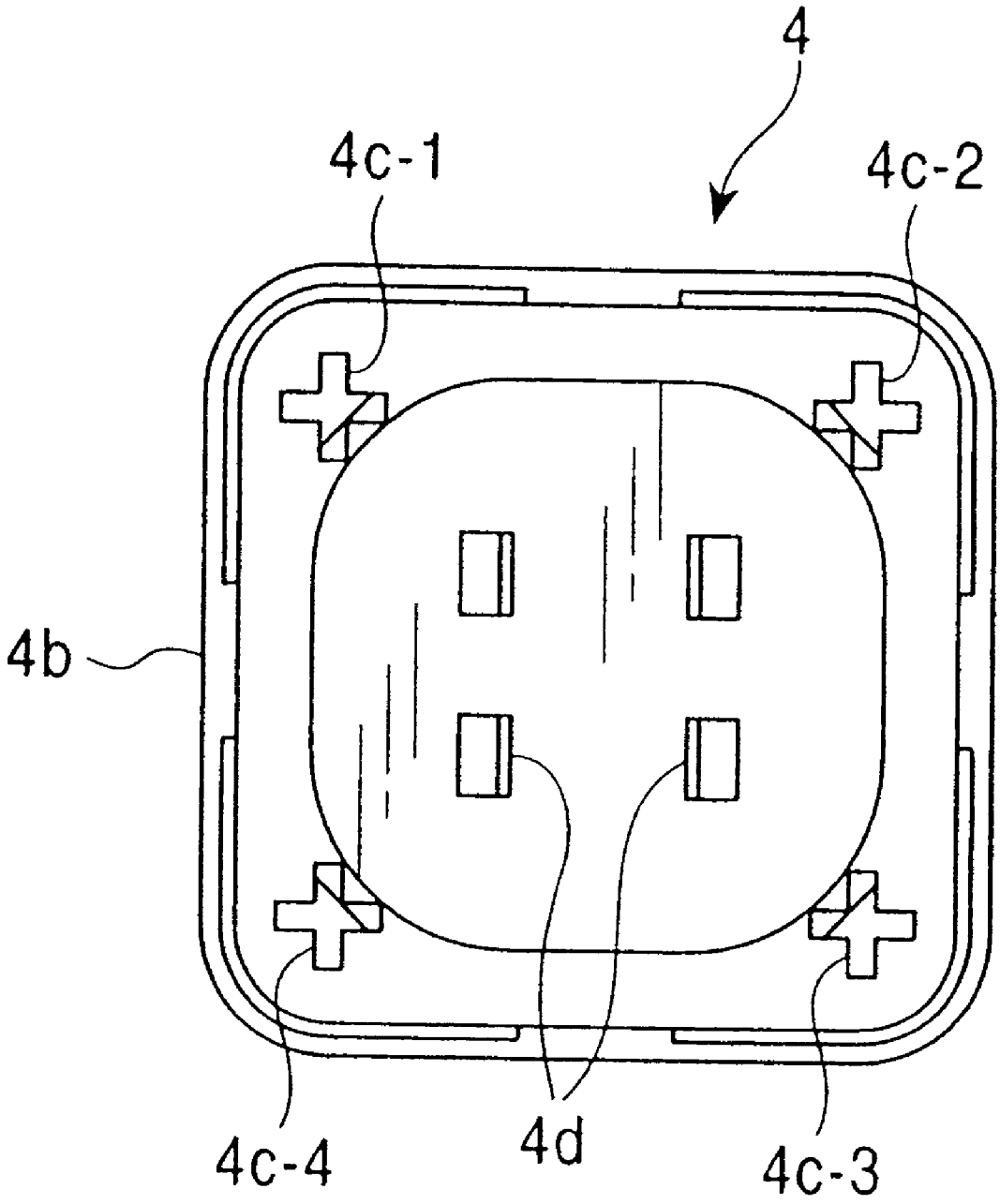
FIG. 6 is a bottom view of the operating member of the embodiment of the switch device in accordance with the present invention.

As shown in FIGS. 4 to 6, an operating member 4 is formed of, for example, a synthetic resin material by molding. The operating member 4 comprises a substantially rectangular top wall 4*a*, side walls 4*b*, cylindrical first, second, third, and fourth actuating sections 4*c*-1, 4*c*-2, 4*c*-3, and 4*c*-4 which are cross-shaped in cross section, and two pairs of engaging members 4*d* which protrude inwardly from substantially the center portion of the top wall 4*a*. The side walls 4*b* extend substantially vertically from the peripheral end of the top wall 4*a* so as to surround the peripheral portion of the top wall 4*a*. The first, second, third, and fourth actuating sections 4*c*-1, 4*c*-2, 4*c*-3, and 4*c*-4 protrude inwardly from near the four corresponding corners of the top wall 4*a*.

Figure 7:
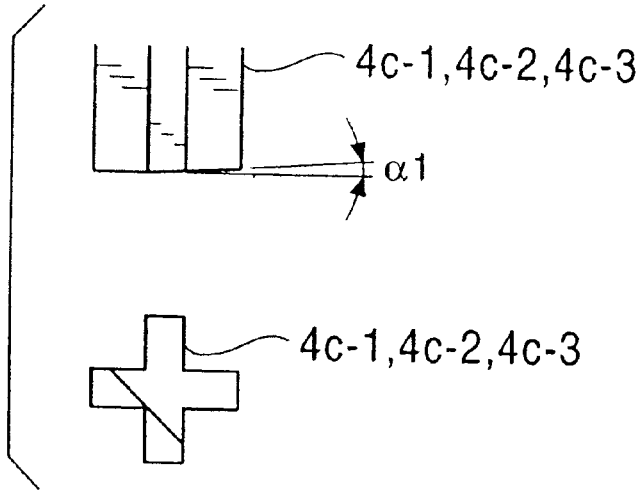
FIG. 7 is a first diagram illustrative of the operating member of the embodiment of the switch device in accordance with the present invention.
Figure 8:
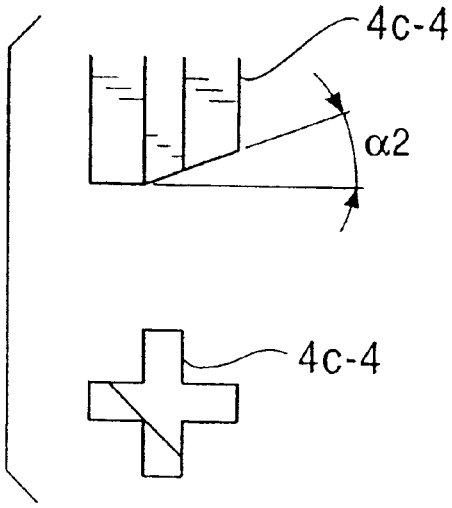
FIG. 8 is a second diagram illustrative of the operating member of the embodiment of the switch device in accordance with the present invention.
Figure 9:
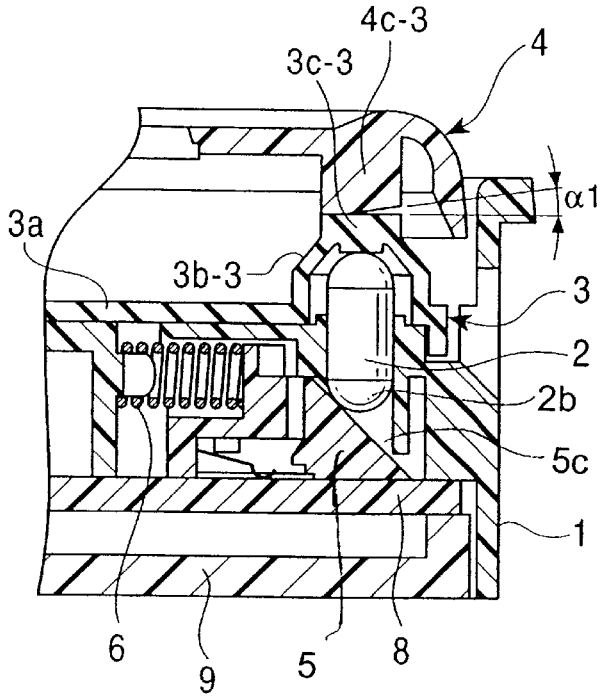
FIG. 9 is an enlarged sectional view of the main portion of the embodiment of the switch device in accordance with the present invention.

An end of each of the first, second, third, fourth actuating sections 4*c*-1, 4*c*-2, 4*c*-3, and 4*c*-4 of the operating member 4 is formed with a predetermined tilt angle with respect to the top wall 4*a*, that is, a horizontal plane so as to extend radially outward from substantially the center of the operating member 4. Here, as shown in FIG. 7, the end of each of the first, second, third actuating sections 4*c*-1, 4*c*-2, and 4*c*-3 is formed with a first tilt angle $\alpha 1$ of, for example, approximately three degrees, while, as shown in FIG. 8, the end of the fourth actuating section 4*c*-4 is formed with a second tilt angle $\alpha 2$ (which is greater than $\alpha 1$) of, for example, approximately 19 degrees. As a result, with an angle of $\alpha 1$, the end of each of the first, second, and third actuating sections 4*c*-1, 4*c*-2, and 4*c*-3 oppose their corresponding first, second, and third presser sections 3*c*-1, 3*c*-2, and 3*c*-3. On the other hand, with an angle of $\alpha 2$, the end of the fourth actuating section 4*c*-4 opposes the fourth presser section 3*c*-4.

The operating member 4 is disposed inside the recess 1*c* so as to virtually cover the open end of the recess 1*c* of the case 1. At this time, the ends of the first, second, third, and fourth actuating sections 4*c*-1, 4*c*-2, 4*c*-3, and 4*c*-4 are in contact with flat ends of the first, second, third, and fourth presser sections 3*c*-1, 3*c*-2, 3*c*-3, and 3*c*-4 of the rubber spring 3, respectively. When the first, second, third, and fourth presser sections 3*c*-1, 3*c*-2, 3*c*-3, and 3*c*-4 are in contact with their corresponding first, second, third, and fourth actuating sections 4*c*-1, 4*c*-2, 4*c*-3, and 4*c*-4, the operating member 4 remains pushed outward (that is, resiliently biased outward) from the case 1.

Here, the two pairs of engaging members 4*d* of the operating member 4 are engaged with the peripheral wall of the square hole 1*e* formed at the recess 1*c* by a suitable means, such as a snapping-in method. By the engagement of the two pairs of engaging members 4*d* with the peripheral wall of the square hole 1*e*, the operating member 4 is constructed so that it is not dislodged from the case 1, and so that it is rockably disposed inside the recess 1*c*.

A plurality of sliding members 5 are provided, each of which comprising a substantially wedge-shaped base 5*a*, a recess 5*b* which is formed in the top surface of the corresponding base 5*a*, and an inclined section 5*c* which is formed at one end of the corresponding base 5*a*.

For example, three sliding members 5 are slidably accommodated inside the case 1. The ends 2*b* of each actuating member 2 is in contact with its corresponding inclined section 5*c*.

Coil springs 6 are formed of a metallic material into spiral forms with predetermined diameters. One end of each coil spring 6 is accommodated inside the recess 5*b* of its corresponding sliding member 5, whereas the other end of each coil spring 6 is in contact with the case 1. By the coil springs 6, the corresponding sliding members 5 are resiliently biased to one side.

Movable contacts 7 are formed of a metallic material, such as phosphor bronze, by a pressing operation, and comprise a plurality of sliding elements 7*a*. The movable contacts 7 are affixed to the corresponding sliding members 5 by a suitable means, such as thermal caulking, so that the movable contacts 7 slide as their corresponding sliding members 5 slide.

A printed wiring board 8 comprises a plurality of stationary contacts (such as three stationary contacts) 8*a* which are formed on one surface thereof, a light-emitting element 8*b*, and a plurality of solder lands 8*c*.

The printed wiring board 8 is disposed inside the case 1.

The sliding members 5 having the corresponding movable contacts 7 affixed thereto are disposed above the printed wiring board 8 at locations which allow the movable contacts 7 to come into contact with and separate from their corresponding stationary contacts 8*a*. The sliding members 5 are formed such that, when they slide, the corresponding movable contacts 7 slide above their corresponding stationary contacts 8*a* so as to come into contact with and separate from their corresponding stationary contacts 8*a*.

Here, the stationary contacts 8*a* and their corresponding sliding members 5 having the corresponding movable contacts 7 affixed thereto form what are called switches. The switches are constructed only at locations which oppose their corresponding first, second, and third presser sections 3*c*-1, 3*c*-2, and 3*c*-3 of the rubber spring 3. Each of the switches is actuated by its corresponding actuating member 2.

A cover 9 is formed of, for example, a synthetic resin material by molding. The cover 9 comprises a substantially rectangular wall 9*a*, side walls 9*a* which extend substantially vertically from the peripheral edge of the wall 9*a*, and a plurality of terminals 9*c* which are formed integrally with the wall 9*a* by insert molding on the wall 9*a*. The printed wiring board 8 is disposed on the wall 9*a* of the cover 9 with the terminals 9*c* being disposed so as to pass through their corresponding solder lands 8*c*. Here, the solder lands 8*c* and the terminals 9*c* are soldered together, whereby the printed wiring board 8 and the cover 9 are integrally formed.

The cover 9 which is formed integrally with the printed wiring board 8 is disposed so as to cover the open portion (not shown) of the case 1. The case 1 and the cover 9 are engaged together by a suitable means, such as a snapping-in connecting operation.

A description of the operation of the switch device of the present invention will now be given.

First, as shown in FIG. 1, when the operator presses, for example, substantially the center portion of the lower left end side of the operating member 4 shown in FIG. 1 with, for example, his/her finger (not shown), the operating member 4 tilts to the left side. When the operating member 4 tilts to the left side, the first and second actuating sections 4*c*-1 and 4*c*-2 of the operating member 4 are pushed downward. When the first and second actuating sections 4*c*-1 and 4*c*-2 are pushed downward, the first and second presser sections 3*c*-1 and 3*c*-2 of the rubber spring 3 which have been brought into contact with their corresponding first and second actuating sections 4*c*-1 and 4*c*-2 are pushed downward.

When the first and second presser sections 3*c*-1 and 3*c*-2 of the rubber spring 3 are pushed, the first and second spring sections 3*b*-1 and 3*b*-2 are buckled as the operator is provided with a tactile feel, so that the operator is provided with a suitable tactile feel. Here, the first and second presser sections 3*c*-1 and 3*c*-2 cause the two actuating members 2 which are in contact with the inside walls of their corresponding first and second presser sections 3*c*-1 and 3*c*-2 to be pushed and to slide downward.

When the two actuating members 2 slide downward, the ends 2*b* of each of the two actuating members 2 move downward on the inclined sections 5*c* of the two corresponding sliding members 5. At this time, the two sliding members 5 slide, along with their corresponding movable contacts 7, above their corresponding stationary contacts 8*a* which are formed on the printed wiring board 8 so as to go against the resilient forces of the corresponding coil springs 6.

When these two sliding members 5 slide, the corresponding movable contacts 7 come into contact with their corresponding stationary contacts 8*a*, so that two switches are brought into an on state at the same time.

Next, when the operator moves his/her finger off the operating member 4, the resilient forces of the two coil springs 6 cause the two corresponding sliding members 5 to slide back to their original positions. Here, the two movable contacts 7 separate from their corresponding stationary contacts 8*a*, so that the two switches are brought into an off state.

By the sliding of the two sliding members 5, the corresponding actuating members 2 are pushed upward, and the operating member 4 is pushed upward to its original position by the self-restoring force of the rubber spring 3.

As shown in FIG. 1, when the operator presses, for example, substantially the center portion of the upper left end side of the operating member 4 shown in FIG. 1 with, for example, his/her finger (not shown), the operating member 4 tilts to the left side. When the operating member 4 tilts to the left side, the first and fourth actuating sections 4c-1 and 4c-4 of the operating member 4 are pushed downward. When the first and fourth actuating sections 4c-1 and 4c-4 are pushed downward, the first and fourth presser sections 3c-1 and 3c-4 of the rubber spring 3 which have been brought into contact with the corresponding first and fourth actuating sections 4c-1 and 4c-4 are pushed downward.

Figure 10:
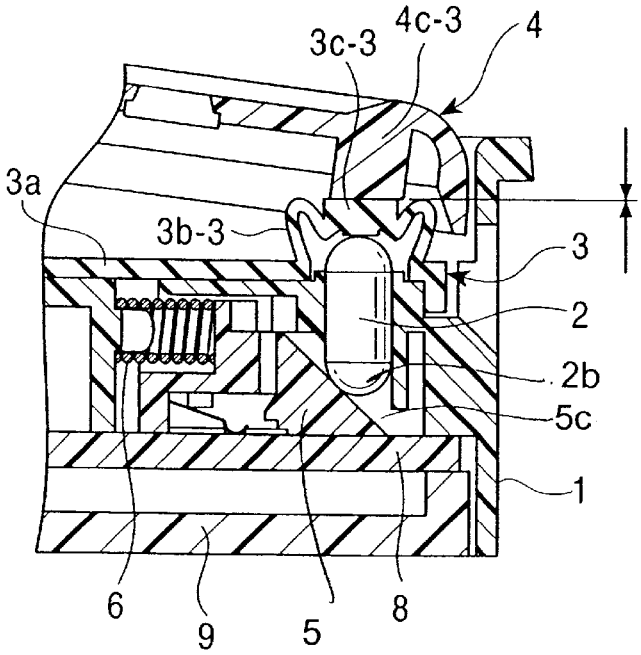
FIG. 10 is a first diagram illustrative of the operation of the switch device in accordance with the present invention.
Figure 11:
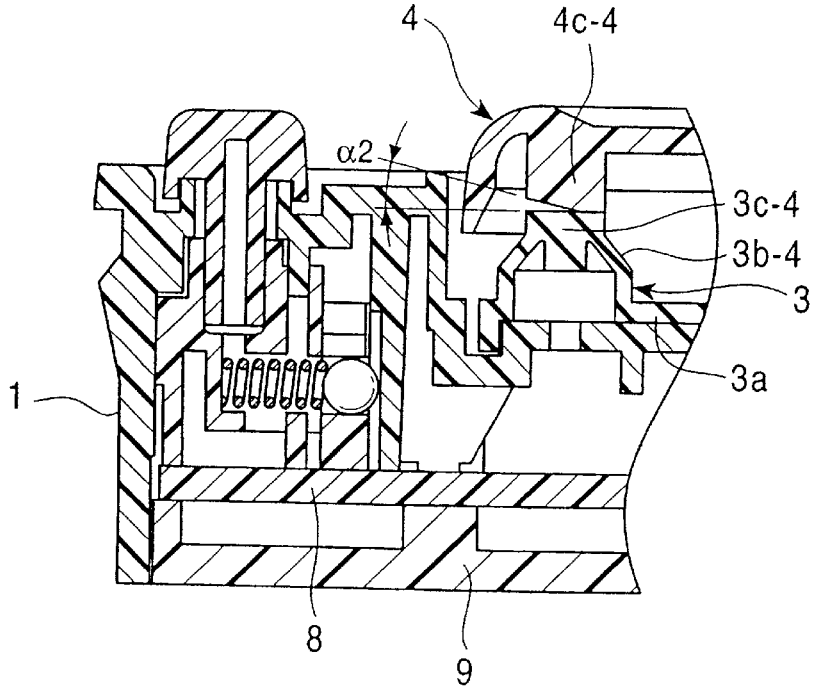
FIG. 11 is an enlarged sectional view of the main portion of the switch device in accordance with the present invention.
Figure 12:
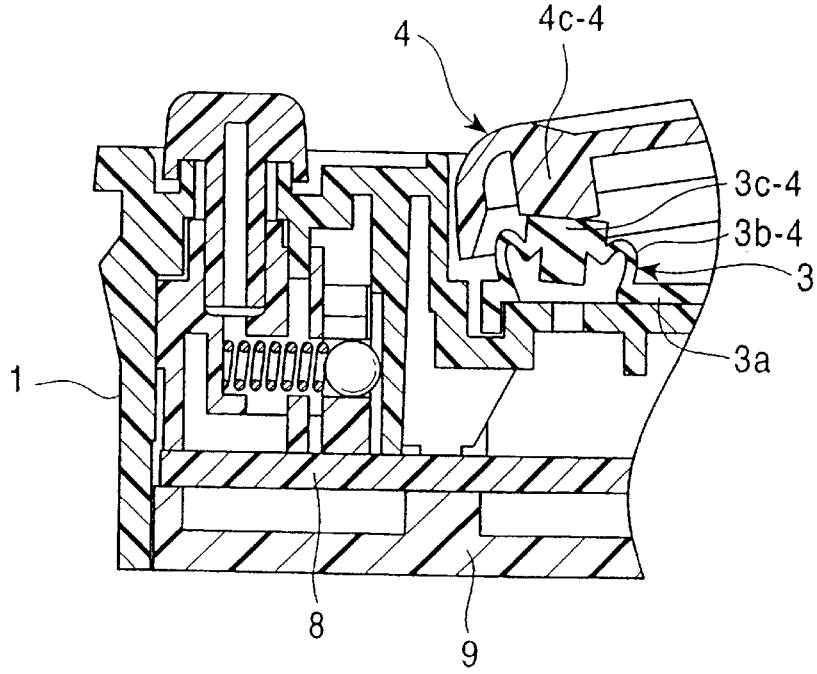
FIG. 12 is a second diagram illustrative of the operation of the switch device in accordance with the present invention.

When the first and fourth presser sections 3c-1 and 3c4 of the rubber spring 3 are pushed, the first and fourth spring sections 3b-1 and 3b-4 are buckled as the operator is provided with a tactile feel, so that the operator is provided with a suitable tactile feel. At this time, as shown in FIG. 10, the end of the first presser section 3c-1 moves to a location which is substantially parallel to the base 3a, while, as shown in FIG. 12, the end of the fourth presser section 3c-4 moves to a location which is at a predetermined angle from a location which is parallel to the base 3a. By virtue of these movements, the change in load of the tactile feel which is provided by the fourth spring section 3b-4 is somewhat smaller than that of the tactile feel which is provided by the first presser section 3c-1 which moves to a location which is substantially parallel to the base 3a.

Here, the first presser section 3c-1 causes the one actuating member 2 which is in contact with the inside wall of the first presser section 3c-1 to be pushed and to slide downward. When the one actuating member 2 slides downward, the ends 2b of the one actuating member 2 move downward on the inclined section 5c of the one sliding member 5 corresponding thereto. At this time, the one-sliding member 5 slides, along with the corresponding movable contact 7, above the corresponding stationary contact 8a which is formed on the printed wiring board 8 so as to go against the resilient force of the corresponding coil spring 6.

When the one sliding member 5 slides, the corresponding movable contact 7 comes into contact with the corresponding stationary contact 8a, so that the corresponding one switch is brought into an on state.

As described above, even if switches are disposed in correspondence with the spring sections, that is, the first and fourth spring sections 3b-1 and 3b-4 which provide corresponding tactile feels, or even if these switches are not disposed, the operator can experience substantially the same tactile feel. Therefore, although only one switch is being turned on, the clicking characteristic is substantially the same as the clicking characteristic which is provided when two switches are turned on.

Next, when the operator moves his/her finger off the operating member 4, the resilient force of the corresponding one coil spring 6 causes the corresponding one sliding member 5 to slide back to its original position. Here, the corresponding movable contact 7 separates from its corresponding stationary contact 8a, so that the one switch is brought into an off state.

By the sliding of the one sliding member 5, the corresponding actuating member 2 is pushed upward, and the operating member 4 is pushed upward to its original position by the self-restoring force of the rubber spring 3.

Thereafter, when the operator presses, for example, substantially the center portion of the lower right end side of the operating member 4 shown in FIG. 1 with, for example, his/her finger (not shown), the operating member 4 operates similarly to the case where the lower left end side of the operating member 4 is pressed, so that two switches are brought into an on state at the same time.

Next, when the operator presses, for example, substantially the center portion of the upper right end side of the operating member 4 shown in FIG. 1 with, for example, his/her finger (not shown), operations which are similar to those which are executed when the upper left end side of the operating member 4 is pressed are executed, causing one switch to be brought into an on state.

Accordingly, based on the direction of operation when any of the four pressing locations of the rectangular operating member 4 are operated, a determination is unambiguously made as to the location of the switch or the locations of the switches to be turned on or the number of switches to be turned on. Consequently, a determination is made as to which location (that is, the upper lower, left, or right side) of the pressing portion of the operating member 4 is operated.

A description of the clicking characteristics in the operation of the switch device will now be given.

Figure 13:
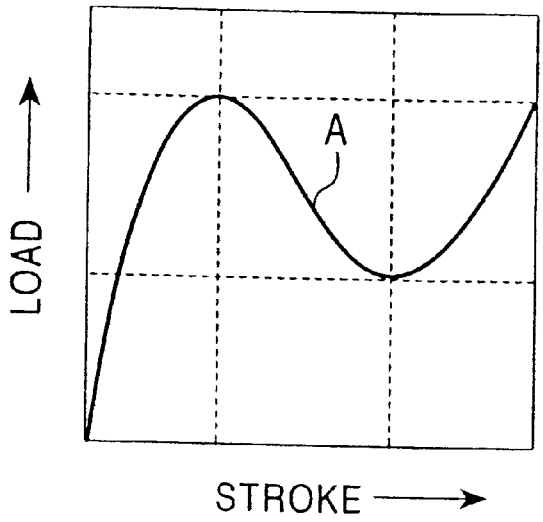
FIG. 13 is a graph illustrating the clicking characteristic which is provided when two switches of the switch device of the present invention are actuated.
Figure 14:
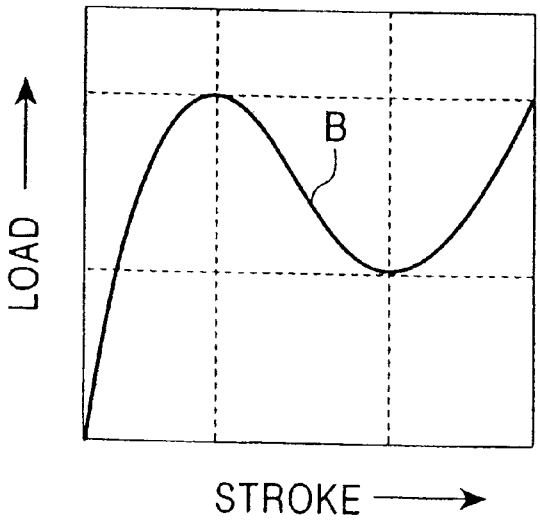
FIG. 14 is a graph illustrating the clicking characteristic which is provided when one switch of the switch device of the present invention is actuated.
Figure 15:
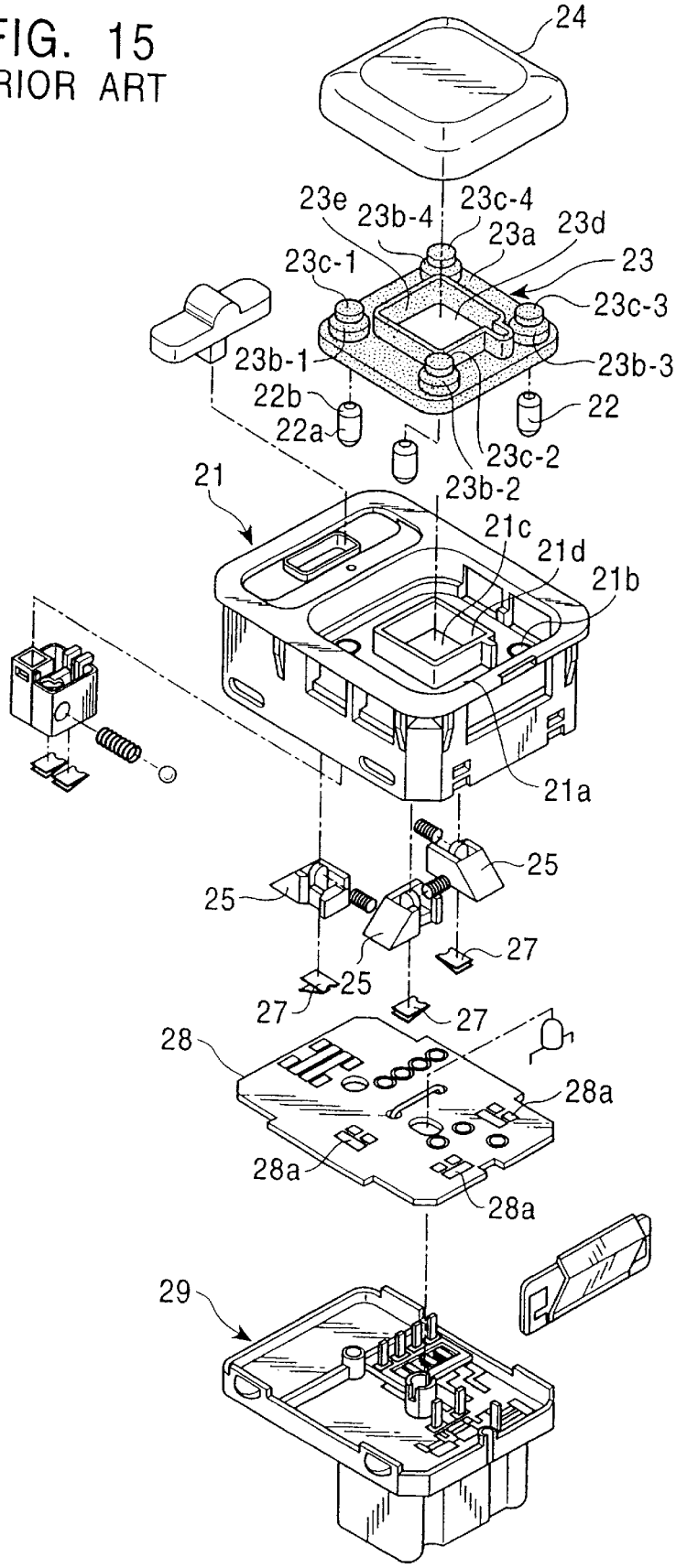
FIG. 15 PRIOR ART
FIG. 15 is an exploded perspective view of a conventional switch device.
Figure 16:
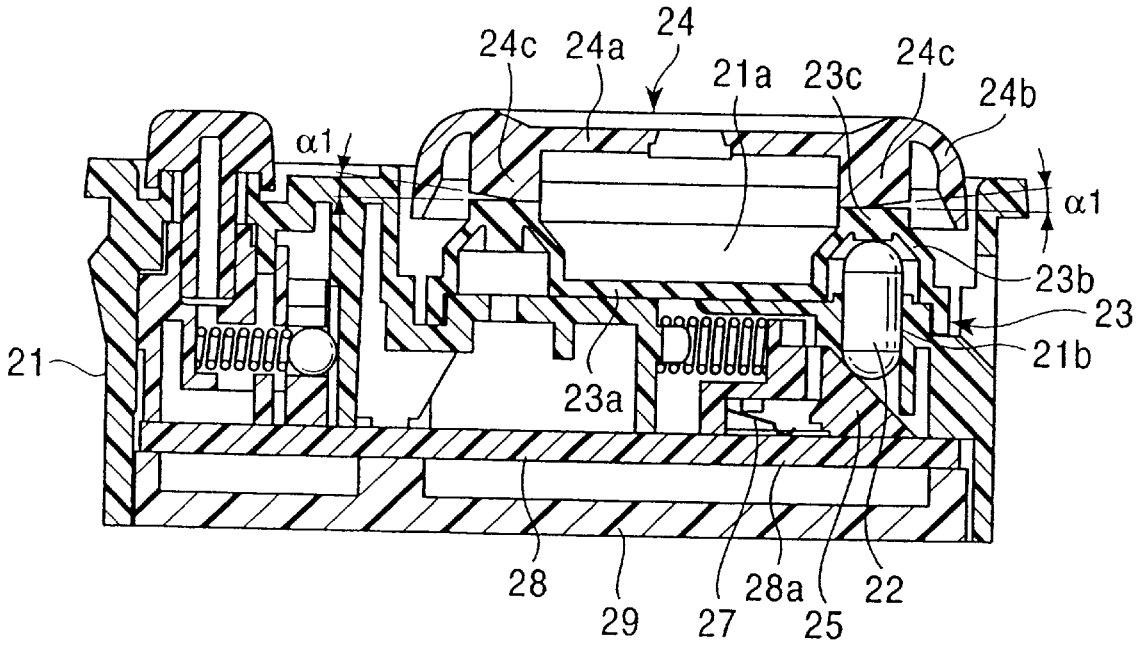
FIG. 16 PRIOR ART
FIG. 16 is an enlarged sectional view of the conventional switch device.
Figure 17:
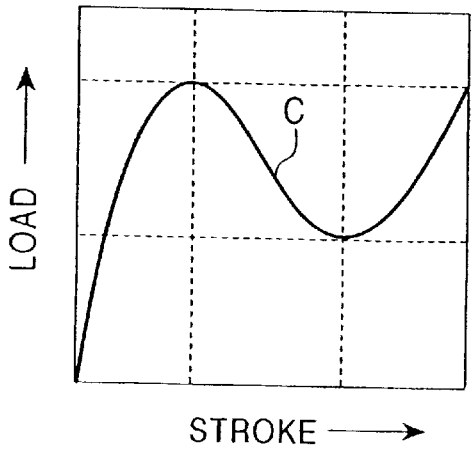
FIG. 17 PRIOR ART
FIG. 17 is a graph illustrating the clicking characteristic which is provided when one switch of the conventional switch device is actuated.
Figure 18:
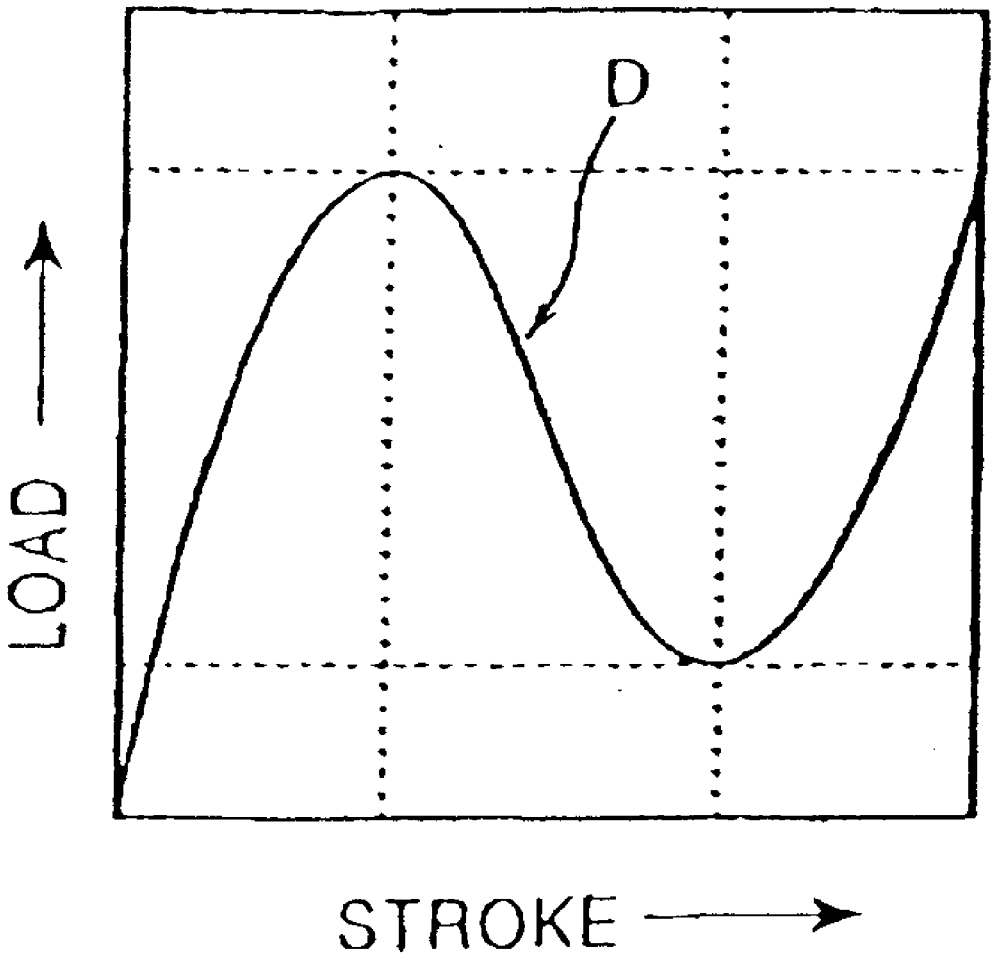
FIG. 18 PRIOR ART
FIG. 18 is a graph illustrating the clicking go characteristic which is provided when two switches of the conventional switch device are actuated.

FIG. 13 is a graph illustrating the clicking characteristic which is provided when two switches are actuated as a result of pressing substantially the center portion of the lower left end of the operating member in the switch device of the present invention shown in FIG. 1. FIG. 14 is a graph illustrating the clicking characteristic which is provided when one switch is actuated as a result of pressing substantially the center portion of the upper left end of the operating member in the switch device of the present invention shown in FIG. 1.

The clicking characteristic which is obtained when two switches are actuated is represented by graph A shown in FIG. 13. The clicking characteristic is such that the difference between the peak value and the bottom value is somewhat small because the tactile feel which is produced by the buckling of two spring sections of the rubber spring 3 is diminished as a result of the operation of two switches which are actuated by the operation of the operating member 4.

The clicking characteristic which is obtained when one switch is actuated is represented by graph B shown in FIG. 14. The clicking characteristic is such that the difference between the peak value and the bottom value is somewhat small. To obtain this clicking characteristic, only one switch is operated by the operation of the operating member 4, so that the tactile feel which is produced by the buckling of two spring sections of the rubber spring 3 is diminished by an amount corresponding to the operation of only one switch. An end of the fourth actuating section 4c-4 of the operating member 4 is formed with a tilt angle of $\alpha 2$. The end of the fourth actuating section 4c-4 pushes an end of the fourth presser section 3c-4 which is formed on the fourth spring section 3b-4, so that the end of the fourth presser section 3c-4 moves with respect to the base 3a with a tilt angle. Therefore, the rubber spring 3 cannot buckle smoothly, thereby producing this clicking characteristic. The clicking characteristic which is represented by graph B is substantially the same as that which is represented by graph A.

Although, in the above-described switch device, the actuating sections of the operating member 4 have inclined surfaces with different tilt angles, the present invention is not limited thereto, so that it is obvious that, for example, the presser sections of the rubber spring may have inclined surfaces with different tilt angles.

As can be understood from the foregoing description, in the switch device of the present invention, the operating member comprises a plurality of actuating sections, opposing their corresponding spring sections, for operating the corresponding spring sections. The switches are switched by actuating the spring sections. The ends of the actuating sections which oppose the spring sections are inclined in the outward direction of the operating member. The tilt angle of the actuating section which opposes the spring section which is not provided along with a switch is greater than the tilt angles of the actuating sections which oppose the corresponding spring sections which are provided along with the corresponding switches. Therefore, it is possible to provide a switch device in which the tactile feel which is provided by operating the spring section which is not provided along with a switch and the tactile feel which is provided by operating the spring sections which are provided along with the corresponding switches are substantially the same.

According to the switch device of the present invention, there may be four spring sections and three switches. Here, when the operating member rocks, two spring sections are actuated at the same time. Therefore, it is possible to provide a low-cost switch device which can determine which of the four operating locations of the operating member which are provided in four corresponding directions is operated using three switches because a determination is made as to which switch or switches are turned on.

According to the switch device of the present invention, the tilt angles of ends of the actuating sections which oppose the spring sections which are provided along with the corresponding switches are set such that, when the operating member rocks, it comes into close contact with ends of the spring sections in a parallel arrangement. Therefore, it is possible to provide a switch device which allows an operator to be provided with a more suitable tactile feel.

According to the switch device of the present invention, the actuating sections are resiliently biased by their corresponding spring sections. By the resilient biasing forces, the operating member is stopped by the case. Therefore, it is possible to provide a low-cost switch device which makes it possible to easily engage the operating member to the case, and which can be assembled easily.

According to the switch device of the present invention, each switch comprises a common printed wiring board which is disposed inside the case, a stationary contact which is formed on the common printed wiring board, a slider which slides above the common printed wiring board, and a movable contact which is disposed on its corresponding slider. Each slider slides by its corresponding spring section in order to switch its corresponding switch. Therefore, it is possible to provide a switch device which is low in cost because the switches which are formed therein are less expensive than a single switch which is accommodated in a housing.

What is claimed is:

1. A switch device comprising:

a case;

an operating member which is rockably supported by the case, the operating member including a plurality of actuating sections;

a plurality of spring sections which, are disposed inside the case substantially equidistant from a rocking center of the operating member, the plurality of spring sections being actuated by the actuating sections; and a plurality of switches which are disposed inside the case, the plurality of switches being switched by corresponding actuating sections;

wherein, when the operating member is not operated, the actuating sections and the spring sections oppose each other with predetermined tilt angles in an outward direction of the operating member; and wherein a total number of switches is less than a total number of spring sections so that a first of the spring sections is provided along with a corresponding switch and a second of the spring sections is not provided along with a switch, a tilt angle which corresponds to the second spring section being larger than a tilt angle which corresponds to the first spring section, tactile feel produced by the first spring section and diminished by operation of the corresponding switch and tactile feel produced by the second spring section are approximately uniform.

2. A switch device according to claim 1, wherein the tilt angle of an end of the mactuating section which opposes the corresponding spring section which is provided along with the corresponding switch is set such that, when the operating member rocks, the operating member comes into close contact with an end of the corresponding spring section at a substantially horizontal location the moment the spring section buckles.

3. A switch device according claim 2, wherein the actuating sections are resiliently biased by the spring sections, the operating member being stopped by the case by resilient forces of the spring sections.

4. A switch device according to claim 3, wherein four of the spring sections and three of the switches are provided, and wherein two of the four spring sections are actuated at the same time by rocking the operating member.

5. A switch device according to claim 4, further comprising a printed wiring board disposed inside the case, a plurality of stationary contacts formed on the printed wiring board corresponding thereto, a plurality of sliders each of which slide above the printed wiring board corresponding to one of the stationary contacts, and a plurality of movable contacts each of which is disposed at a corresponding slider, wherein each slider switches the corresponding switch.

* * * * *

UNITED STATES PATENT AND TRADEMARK OFFICE

CERTIFICATE OF CORRECTION

PATENT NO. : 6,541,716 B2
DATED : April 1, 2003
INVENTOR(S) : Kazunori Gotoh

It is certified that error appears in the above-identified patent and that said Letters Patent is hereby corrected as shown below:

Column 12,
Line 4, immediately after "which" delete "," (comma).
Line 27, delete "mactuating" and substitute -- actuating -- in its place.
Line 34, after "according" insert -- to --.

Signed and Sealed this

Fifteenth Day of July, 2003

JAMES E. ROGAN
*Director of the United States Patent and Trademark Office*